United States Patent [19]

Cavalieri

[11] Patent Number: 4,821,842

[45] Date of Patent: Apr. 18, 1989

[54] SECURITY UNIT FOR A HANGING STAGE SCAFFOLDING

[76] Inventor: Michel Cavalieri, 64 rue Massue, Vincennes, France

[21] Appl. No.: 219,023

[22] Filed: Jul. 14, 1988

[30] Foreign Application Priority Data

Jul. 21, 1987 [FR] France ..... 87 10276

[51] Int. Cl.[4] ..... E04G 3/10; B66D 1/58

[52] U.S. Cl. ..... 182/19; 182/144

[58] Field of Search ..... 182/19, 144, 143, 142, 182/112

[56] References Cited

U.S. PATENT DOCUMENTS

| | | | |
|---|---|---|---|
| 1,710,442 | 4/1929 | Warshaw | 182/144 |
| 3,586,125 | 6/1971 | Derand . | |
| 4,106,753 | 8/1978 | Cavalieri et al. . | |
| 4,237,999 | 12/1980 | Batreau . | |
| 4,316,602 | 2/1982 | Desplats . | |
| 4,462,484 | 7/1984 | Crudele . | |

FOREIGN PATENT DOCUMENTS

| | | |
|---|---|---|
| 838434 | of 1976 | Belgium . |
| 2732516 | of 1979 | Fed. Rep. of Germany . |
| 626187 | 9/1978 | U.S.S.R. . |

*Primary Examiner*—Reinaldo P. Machado
*Attorney, Agent, or Firm*—Bachman & LaPointe

[57] ABSTRACT

A security unit for a hanging stage scaffolding motorized by two electric winches of which each is supplied through a control circuit, said stage having a platform or gondola directly or indirectly suspended by two lugs pivotally mounted on each of said winches, respectively, characterized in that each lug carries a pin adapted to penetrate a slit in a slide to move towards the left or right said slide according to the default of the gondola to the horizontal, the displacement of said slide being adapted to bring it in contact with a switch included in said control circuit and to cause the opening thereof.

8 Claims, 2 Drawing Sheets

SECURITY UNIT FOR A HANGING STAGE SCAFFOLDING

The present invention relates a security unit for a hanging stage scaffolding motorized by two electric winches of which each is supplied through a control circuit, said stage having a platform or gondola directly or indirectly suspended by two lugs pivotally mounted on each of said winches, respectively.

In the known scaffoldings of this type, the gondola is joined to a pair of winches that are controlled either individually, which necessitates the presence of two operators or the alternate operation of the two winches, or simultaneously by means of a central electric switch box to which the two winches are connected.

These scaffoldings are supplied with security systems for the case where the gondola would be inclined, moderately or excessively, in regards to the horizontal.

These means generally use a pendulum striking a mini-ruptor or a system of mercury bulbs placed in the central switch box. However, the inertia of the pendulum or of the mercury tends to give a jerking effect despite the eventual presence of shock-absorbers.

The present invention provides means to automatically correct the inclination of the gondola when said inclination remains lower than a pre-determined threshold or to stop the motors when the inclination becomes excessive.

To this effect, each lug carries a pin adapted to penetrate a slit in a slide to move towards the left or right said slide according to the default of the gondola to the horizontal, the displacement of said slide being adapted to bring it in contact with a switch included in said control circuit and to cause the opening thereof.

More precisely, the slide carries three protuberances by the intermediary of which said slide is adapted to contact a first, second, or third switch included in the control circuit of the winch motors and to cause the opening thereof.

The opening of the first switch (excessive inclination of the gondola) totally stops the motors of the two winches, while the opening of the second or third switches (moderate inclination of the gondola) stops the motor of the winch which is the highest, when raising, or the lowest, when descending.

The second and third switches close as soon as the cause which provoked their opening ceases. To the contrary, means are provided, one the one hand, to prevent the first switch to close by itself even if the cause which provoked its opening has ceased, and on the other hand, manually operated closing means for said first switch.

In addition to the security systems acting in case of moderate or excessive inclination of the gondola, the motorized hanging-stage scaffoldings must be equipped with security means to detect a overload of the gondola, or on the contrary, a load less than normal. This latter situation can occur when the gondola, in descending, touches the ground or encounters an obstacle, as for example a balcony.

With the known hanging-stage scaffoldings, the overload detection is obtained:

1. either by a measure of the electric intensity,
2. or by means using the compression of a spring balance.

The accuracy of the measure of the electric intensity is poor because the intensity varies with the voltage of the network and, in the specific case of hanging-stage scaffoldings, the winches are supplied with electricity by long electric wires, a source of voltage loss. Concerning the system of the balance spring, it is certainly economic and easily ajustable, but it has the tendancy to give a jerking effect.

For detecting a load less than normal, there are currently in use:

1. either the measure of the tenseness of the suspension cable in that, when the gondola rests on an obstacle, the cable becomes slack,
2. or the operation of a switch by a device provided on the anchorage of the gondola or the winch housing, which device is subject to, on one hand, the load, and on the other hand, the opposed action of a spring.

The measure of the tenseness of the cable is relatively inefficient against catching on an obstacle while descending because it does not react unless the load is totally cancelled. The deplacement of a device again the force of a spring is, contrarywise, an interesting solution that is exploited in the present invention.

As it appears from the preceding analysis of the state of the art, separate means are used to detect the overload and the underload.

The present invention provides, to the contrary, a security unit of a simple and reliable construction and that uses means common to the two types of detection.

To this effect, according to the invention, each suspension lug of the gondola is articulatedly mounted on a lever capable of acting on two electric contacts, said lever being kept remote from said contacts by elastic means suitably calibrated as long as the force F, to which is subjected said lug, is inferior to a first threshold S1 and superior to a second threshold S2, the passing of force F to a level superior to S1 (overload) causing a first element of said lever to act upon and to open, said first switch, and the passing of the force F to a level inferior to S2 (underload) causing a second element of said lever to act upon, and to open, a fourth switch included in the power supply circuit of each winch.

It is intended that, in the present description and in the claims, "lever" means a simple lever as well as an ensemble of articulated levers.

According to a preferred embodiment of the invention, there is provided a pivot point capable of occupying two stable positions defined by two stops, the first position being imposed on said pivot point by the force F', that the lever transmits to said pivot point from the lug when this force is superior to the calibration of the spring means which corresponds to the underload threshold, and the second position being imposed on said pivot point by said spring means when this force F' is lower than said calibration.

As mentioned above, the opening of the first switch causes the total stopping of the motors. This occurs in case of overload. On the contrary, in case of underload, the opening of the fourth switch causes only the stopping of the motors as far as the downward motion is concerned, since the system must allow the upward motion of the gondola for freeing same from the obstacle by which it is caught.

In a preferred embodiment, the fourth switch closes as soon as the cause which provokes its opening ceases.

As it can be understood, the same first switch is used for two types of security systems: overload and excessive inclination of the gondola.

The security unit according to the invention can be enclosed in a casing mounted between a conventional winch and the gondola, or preferably be incorporated within the winch itself and, of course, such winches enter the scope of the invention.

Further features and advantages of the invention will become apparent from the description of the attached drawings in which.

Figure 1:
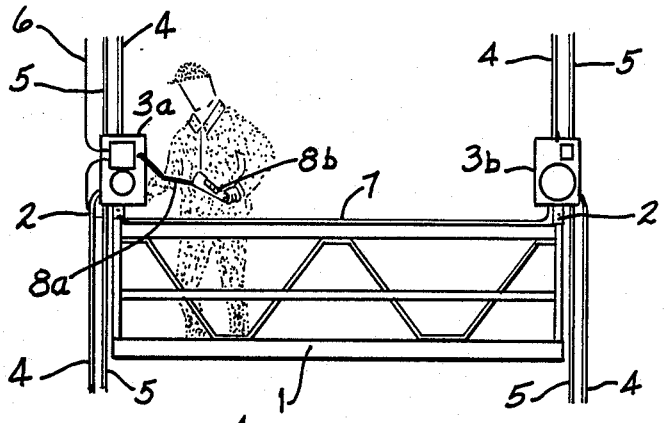
FIG. 1 is a diagrammatic illustration of a hanging-stage scaffolding provided with two winches according to the invention.

FIG. 1 shows a gondola 1 suspended by two lugs 2 from a pair of winches 3a–3b of which the suspension cables are designated by reference 4 and of which the security cables are designated by reference 5. Their electrical connection excepted, winches 3a and 3b are identical, but mounted inversely, so that in FIG. 1, one sees one of the faces of the winch on side 3b and the opposite face of the winch on side 3b. Winch 3a, called "driving winch", is connected to the electric network by the electric wire 6 and it supplies winch 3b called "driven winch" through wire 7. Winch 3a is provided with a control cable 8a connected to a control button box 8b.

The suspension cables 4 and the security cables 5 are anchored to brackets above and counterweights are affixed to the lower end of the cables.

Figure 2:
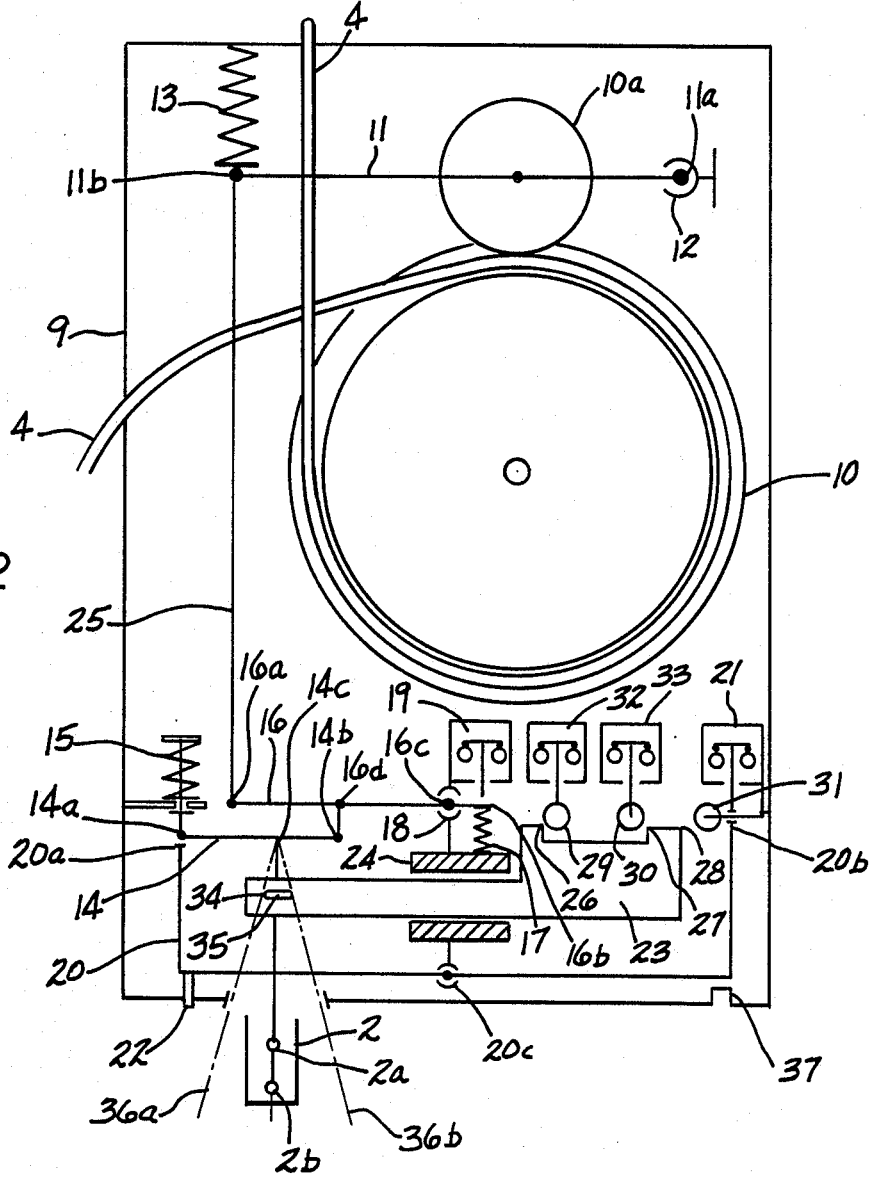
FIG. 2 is a diagrammatic illustration of the security means included in the winches of FIG. 1 and which, in this specific case, are self-tightening winches.

If one refers to FIG. 2, reference 9 designates the casing of winch 3a or 3b. Suspension cable 4 penetrates into casing 9 and winds itself around a friction pulley 10, in a groove provided to this effect, then exits the casing 9. Security cable 5 equally traverses the casing 9 but it has not been represented so as to clarify the drawings. A roller 10a is mounted on a lever 11 of which one end 11a is mounted pivotally in an articulation 12 and of which the other end 11b is subject to the effects of a spring 13. Before the self-tightening effect pushes roller 10a against cable 4, it is the spring 13 that forces roller 10a to press cable 4 into the groove of the friction pulley 10.

As it appears in FIG. 1, gondola 1 is suspended from lugs 2 by means of bolts penetrating appropriates holes 2a, 2b respectively (FIG. 2). Lug 2 is mounted pivotally at 14c and it is joined to a series of articulated levers which will now be described in detail.

This series of levers is comprised of a first lever 14 of which an end 14a is held stationary by a spring 15 as long as the load applied to the lug 2 does not exceed a first pre-determined threshold S1. The other end 14b of lever 14 is joined at 16d to a second lever 16 of which one end 16a is joined to lever 11 through a tie-rod 25 and the other end 16b is held stationary by a spring 17 as long as the load applied to lug 2 remains superior to a second pre-determined threshold S2. Threshold S1 is adjusted by appropriate calibration of spring 15 and threshold S2 is adjusted by appropriate calibration of spring 17. Points 14b and 16d could be fused in practice.

Point 16c of lever 16 can have two stable positions, abutting against the lower end or the higher end of the button-hole 18 so that it provides two pivoting positions to lever 16, according to the load applied to lug 2.

Facing spring 17 and the end 16b of lever 16 is the part controlling the opening of a micro-switch 19 included in the electric circuitry controlling the motor (not shown) of the winch.

The lever system includes furthermore a lever 20, one end 20a of which faces the end 14a of lever 14 and the other end 20b of which faces the part controlling the opening of a micro-switch 21 included in the electric circuitry of the motor. Lever 20 is pivotally mounted around point 20c. Friction means (not shown) are provided for maintaining lever 20 in the pivoted position corresponding to the opening of micro-switch 21 as long as this latter is not brought back to the neutral position by using the manual push button 22. A stop 37 limits the deplacement caused by push button 22.

A slide 23 is mounted to allow for a sliding motion in a guide 24 comprising two parts projecting from housing 9. Spring 17 and button-hole 18 are mounted on guide 24. Slide 23 has a slit or a slot 34 through which projects a pin 35 depending on lug 2. As shown, slide 23 has three active protuberances 26, 27 and 28. These protuberances can contact rollers 29, 30 and 31 acting on the part controlling the opening of switches 32, 33 and 21, respectively.

The device works as follows:

When there is no load when the gondola 1 rests on the ground, spring 13 biases roller 10a against cable 4 so as to permit the driving thereof. Means (not shown) are provided to manually neutralize, at this stage, the underload sensing devices (17, 16b, 19).

When the gondola rises and if the load is normal, that is to say between thresholds S1 and S2, lug 2 transmits said load to lever 14, through points 14c, 14b and 16d. Points 14a and 14b being kept stationary by springs 15 and 17 respectively, pivot point 16c is abutting against the lower end of button-hole 18. As a consequence a force proportional to the load is transmitted through lever 16 to lever 11 and, accordingly, to pressure roller 10a. One will understand that the higher the load applied to lug 2 the higher the pressure applied by roller 10a on cable 4.

In case of overload, the traction effort on lug 2 applies to spring 15, through lever 14, a force higher than that of said spring and lever 14 pivots and brings point 14a against end 20a of lever 20. It results therefrom that lever 20 pivots around point 20c and acts on switch 21. The opening of switch 21, included in the control circuitry of the winch motor, causes the stopping of the motor. As already said, even if the overload which caused this stopping disappears, switch 21 does not close by itself. One has to act manually on push button 22 to bring back lever 20 to its neutral position.

In case of a load lower than threshold S2, the force transmitted to end 16b of lever 16 becomes lower than that of spring 17 and this latter pushes lever 16 which pivots around point 16a for acting on switch 19. Point 16c is now abutting against the higher end of button-hole 18. The opening of switch 19, included in the control circuitry of the winch motor, forbids the winch to have a downward motion, but permits an upward motion.

In case of moderate inclination of the gondola, lug 2 has an inclination included between the oblique lines 36a and 36b. As long as the displacement of pin 35 is such that it does not push against the ends of slot 34, nothing happens. However, if the displacement of pin 35 is greater, it displaces slide 23 towards the left or towards the right. If slide 23 is displaced toward the right, the active point 26 of the slide contacts roller 29 and opens switch 32. If the slide is displaced towards the left, the active point 27 of the slide contacts the roller 30 of the switch 33 and causes its opening. According to the gondola inclination, the motor of that winch which is the highest in case of upward motion, or the lowest in case of downward motion, will be stopped. As a consequence, an automatic horizontal re-adjustment of the gondola is obtained.

If the gondola inclination exceeds a pre-determined threshold, the active point 28 of slide 23 of one of the winches used in the stage will contact roller 31 which, being so raised, will open switch 21 causing the total stopping of the motors of both winches.

It is to be understood that slide 23 is an "inert" component which remains in the place where pin 35 brings it and that, in view of the possible travel of pin 35 within slot 34, slide 23 follows pin 35 with a certain reaction time.

Figure 3:
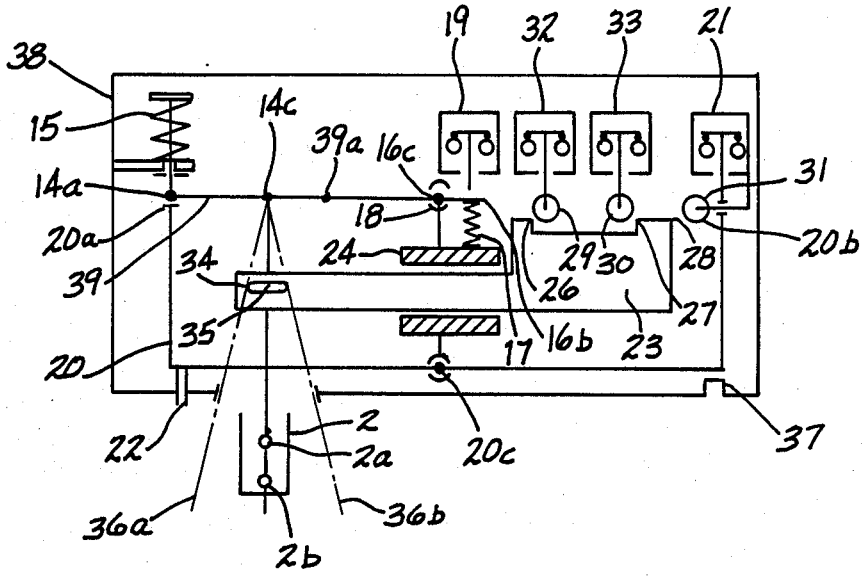
FIG. 3 is a diagrammatic illustration of a separate security unit, which can be adapted to a conventional winch.

In the embodiment shown in FIG. 3, the security unit is enclosed in a separate box 38 which can be associated to a conventional winch. Said box can be affixed either to the winch housing and hang the gondola to lug 2 of box 38 (case of FIG. 3), or to the gondola 1 and hang said box through an articulated lug to the winch box.

On FIG. 3, the security unit structure is very similar to that of FIG. 2 and the same references identify the same parts. The only difference is that levers 14 and 16 of FIG. 2 are fused into a single lever 39 in FIG. 3; that, accordingly, points **14*b* and 16*d* of FIG. 2 are fused into a single point 39*a*, and that lever 39** is independent from the winch structure.

These differences have no incidence on the working of the security unit and thus it is useless to describe it again.

It is to be understood that the invention is not restricted to the described and illustrated embodiments.

In particular, instead of a slot 34, the slide can have a notch offering to pin 35 the same possibilities of lateral motion.

The means provided by the invention and the jaws conventionally acting on security cable 5 of the winches in FIG. 1 could be combined by controlling said jaws through an electric circuitry including an electro-magnet and one of the micro-switches (or more) belonging to the security means according to the invention.

What I claimed is:

1. A security unit for a hanging stage scaffolding motorized by two electric winches of which each is supplied through a control circuit, said stage having a platform or gondola directly or indirectly suspended by two lugs pivotally mounted of each of said winches, respectively, characterized in that each lug carries a pin adapted to penetrate a slit in a slide to move towards the left or right said slide according to the default of the gondola to the horizontal, the displacement of said slide being adapted to bring it in contact with a switch included in said control circuit and to cause the opening thereof.

2. A security unit according to claim 1, characterized in that the slide carries three protuberances by the intermediary of which said slide is adapted to contact a first switch (excessive inclination of the gondola) or a second or third switch (moderate inclination of the gondola) included in the control circuit of the winch motors and to cause the opening thereof.

3. A security unit according to claim 1, characterized in that the slide carries three protuberances by the intermediary of which said slide is adapted to contact a first switch (excessive inclination of the gondola) or a second or third switch (moderate inclination of the gondola) included in the control circuit of the winch motors and to cause the opening thereof, and in that the opening of the first switch totally stops the motors of the two winches.

4. A security unit according to claim 1, characterized in that the slide carries three protuberances by the intermediary of which said slide is adapted to contact a first switch (excessive inclination of the gondola) or a second or third switchh (moderate inclination of the gondola) included in the control circuit of the winch motors and to cause the opening thereof, and in that the opening of the second or third switches stops the motor of the winch which is the highest, when raising, or the lowest, when descending.

5. A security unit according to claim 1, characterized in that the slide carries three protuberances by the intermediary of which said slide is adapted to contact a first switch (excessive inclination of the gondola) or a second or third switch (moderate inclination of the gondola) included in the control circuit of the winch motors and to cause the opening thereof, and in that means are provided, on the one hand, to prevent the first switch to close by itself even if the cause which provoked its opening has ceased, and on the other hand, manually operated closing means for said first switch.

6. A security unit according to claim 1, characterized in that the slide carries three protuberances by the intermediary of which said slide is adapted to contact a first switch (excessive inclination of the gondola) or a second or third switch (moderate inclination of the gondola) included in the control circuit of the winch motors and to cause the opening thereof, and in that each suspension lug of the gondola is articulatedly mounted on a lever capable of acting on two electric contacts, said lever being kept remote from said contacts by elastic means suitably calibrated as long as the force F, to which is subjected said lug, is inferior to a first threshold S1 and superior to a second threshold S2, the passing of force F to a level superior to S1 (overload) causing a first element of said lever to act upon, and to open, said first switch, and the passing of the force F to a level inferior to S2 (underload) causing a second element of said lever to act upon, and to open, a fourth switch included in the power supply circuit of each winch.

7. A security unit according to claim 1, characterized in that the slide carries three protuberances by the intermediary of which said slide is adapted to contact a first switch (excessive inclination of the gondola) or a second or third switch (moderate inclination of the gondola) included in the control circuit of the winch motors and to cause the opening thereof, in that each suspension lug of the gondola is articulatedly mounted on a lever capable of acting on two electric contacts, said lever being kept remote from said contacts by elastic means suitably calibrated as long as the force F, to which is subjected said lug, is inferior to a first threshold S1 and superior to a second threshold S2, the passing of force F to a level superior to S1 (overload) causing a first element of said lever to act upon, and to open, said first switch, and the passing of the force F to a level inferior to S2 (underload) causing a second element of said lever to act upon, and to open, a fourth switch included in the power supply circuit of each winch, and in that there is provided a pivot point capable of occupying two stable positions defined by two stops, the first position being imposed on said pivot point by the force F′, that the lever transmits to said pivot point from the lug when this force is superior to the calibration of the spring means which corresponds to the underload threshold, and the second position being imposed on said pivot point by said spring means when this force F' is lower than said calibration.

8. A two whinch system for hanging stage scaffoldings using winches including the security unit according to claim 1, characterized in that one of the winches, called "driving winch", is power supplied by the electric network and in that the other winch called "driven winch" is power supplied through said one winch.

* * * * *